US006615726B2

(12) United States Patent
Douillard et al.

(10) Patent No.: US 6,615,726 B2
(45) Date of Patent: Sep. 9, 2003

(54) REDUCED VIBRATION PRINTING PRESS AND METHOD

(75) Inventors: Gerald Roger Douillard, Epping, NH (US); Mark Bernard Dumais, Kennebuck, ME (US); Michael Thomas Woroniak, Dover, NH (US); John Allan Manley, Brentwood, NH (US); John Antonios Panteleos, York, ME (US); Charles Francis Svenson, Laconia, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/948,274

(22) Filed: Sep. 6, 2001

(65) Prior Publication Data

US 2002/0066386 A1 Jun. 6, 2002

Related U.S. Application Data

(63) Continuation-in-part of application No. 09/727,994, filed on Dec. 1, 2000, now Pat. No. 6,526,888.

(51) Int. Cl.[7] ..... B41F 31/00

(52) U.S. Cl. ..... 101/483; 101/350.3; 101/DIG. 32; 101/219; 101/484; 492/15

(58) Field of Search ..... 101/483, 484, 101/211, 216, 218, 219, 148, 183, 350.3, 232, 348, 247, 248; 492/15

(56) References Cited

U.S. PATENT DOCUMENTS

| | | | | | |
|---|---|---|---|---|---|
| 515,224 | A | * | 10/1894 | Guaraldi | 101/247 |
| 4,036,131 | A | * | 7/1977 | Elmore | 101/247 |
| 4,493,257 | A | * | 1/1985 | Kubert et al. | 101/350.3 |
| 4,524,692 | A | * | 6/1985 | Rodvelt | 101/DIG. 32 |
| 5,533,448 | A | * | 7/1996 | Klinger | 101/DIG. 32 |
| 5,826,505 | A | * | 10/1998 | Volz et al. | 101/216 |
| 5,845,576 | A | * | 12/1998 | Junghans | 101/484 |
| 5,988,063 | A | * | 11/1999 | Brandenburg et al. | 101/219 |
| 6,142,078 | A | * | 11/2000 | Lachajewski | 101/484 |
| 6,227,113 | B1 | * | 5/2001 | Dorenkamp | 101/350.3 |
| 6,302,019 | B1 | * | 10/2001 | Palmatier et al. | 101/218 |
| 6,318,260 | B1 | * | 11/2001 | Chu et al. | 101/365 |

FOREIGN PATENT DOCUMENTS

| | | |
|---|---|---|
| GB | 2180502 | 4/1987 |
| JP | 8276562 | 10/1996 |

* cited by examiner

*Primary Examiner*—Eugene H. Eickholt
(74) *Attorney, Agent, or Firm*—Davidson, Davidson & Kappel, LLC

(57) ABSTRACT

A method for identifying a lateral position of a vibrator roll geared to a plate cylinder in a printing press includes the steps of sensing a reference lateral position of a vibrator roll, setting a counter to a setting corresponding to the reference lateral position of the vibrator roll and rotating a plate cylinder. The lateral position of the vibrator roll changes as a result of the rotating of the plate cylinder and the counter changes as a function of the rotating of the plate cylinder.

15 Claims, 3 Drawing Sheets

REDUCED VIBRATION PRINTING PRESS AND METHOD

CROSS-REFERENCE TO RELATED APPLICATIONS

The present application is a continuation-in-part of U.S. Ser. No. 09/727,994, filed on Dec. 1, 2000 and now U.S. Pat. No. 6,526,888 the entire disclosure of which is hereby incorporated-by-reference herein.

BACKGROUND OF THE INVENTION

The present invention relates generally to printing presses and more particularly to a method and device for reducing vibrations in printing presses.

Print unit towers have significant side frame vibration while starting up and during operation. One of the major causes of side frame vibration are vibrator rolls, which move laterally so as to provide a more consistent ink coating or dampening solution to a plate cylinder. The vibrations caused by the vibrator rolls may reduce the life of the equipment and also may cause a lateral print double on the printed material, leading to poor print quality and, often, paper waste.

Prior attempts to reduce vibrator roll vibration effects include using a separate motor to drive the lateral motion of the vibrator rolls so that the torque disturbances due to vibrator oscillation can be insulated from the unit drive, or to drive the lateral motion so that vibrator phases can be adjusted relative to one another.

However, using separate motors to drive the vibrator rolls to produce the lateral motion incurs significant additional cost and complexity over the traditional technique of having the lateral and rotational motion of the vibrator rolls driven by the same drive which drives the printing cylinders.

When the lateral motion is driven by the same drive as a corresponding print cylinder, the phasing of the various vibrator rolls for different plate cylinders typically are not controlled, especially if independent motors drive the various plate cylinders. If, for example, during a circumferential registration adjustment of one plate cylinder, the phase of the various vibrator rolls changes, those vibrator rolls may cause increased vibrations, leading to the defects mentioned above.

Japanese Patent Document No. 8-276562 purports to disclose a dynamic dampener for reducing vibrations caused by a reciprocating roller. The dynamic dampener requires a separate device, which can be expensive and can be difficult to maintain.

U.K. Patent Application No. 2 180 502 purports to disclose a device for adjusting the amplitude of the axial reciprocation of ink vibrator rollers. No change in the phasing of the axial reciprocation appears to occur, and the purpose of the device does not appear to be to reduce vibrations in a printing press, but rather to vary the stroke length of the vibrator rollers.

BRIEF SUMMARY OF THE INVENTION

An object of the present invention is to provide a method and device for determining vibrator stroke positions and/or dynamically adjusting phase between vibrator rolls. An alternate or additional object is to reduce vibrations in printing presses.

The present invention provides a method for identifying the lateral position of a vibrator roll geared to a plate cylinder in a printing press comprising the steps of:

sensing a reference lateral position of a vibrator roll;

setting a counter to a specific setting corresponding to the reference lateral position of the vibrator roll; and rotating a plate cylinder, the lateral position of the vibrator roll changing as a result of the rotating, the counter changing as a function of the rotating of the plate cylinder.

The counter thus provides for instant querying of the lateral position of the vibrator roll, as the rotation of the plate cylinder varies the lateral position of the vibrator roll. The sensing of the reference position can take place at a single lateral position of the vibrator roll, for example when the vibrator roll reaches a full extension of a vibrator stroke position.

Preferably, the counter is reset to zero each time the vibrator roll reaches a full extension of a vibrator stroke position.

Preferably, a reference lateral position of a second vibrator roll of an opposing print couple is sensed, a second counter is set to a second specific setting corresponding to the reference lateral position of the second vibrator roll, and a second plate cylinder is rotated. The lateral position of the second vibrator roll changes as a result of the rotating of the second plate cylinder, and the second counter changes as a function of the rotating of the second plate cylinder.

Depending upon the desired phase relationship between the first and second vibrator rolls (for example 180 degrees out of phase), the vibrator roll positions can then adjusted by rotating of one or both plate cylinders, as described for example in the method and device of U.S. Ser. No. 09/727,994.

Preferably, the counter values of the opposite print couples are read at an same instant in time, i.e. "frozen", so that an accurate relationship between the two print couples is established.

Each rotation of a plate cylinder alters the phase of the vibrator roll, and thus if one plate cylinder is rotated 360 degrees while the other plate cylinder is not moved, the phases between the two vibrator rolls can be altered without affecting the register. The amount of phase change in the vibrator roll position per single plate cylinder rotation is referred to herein as the "phase per plate revolution" or number of degrees ND.

If the opposing vibrator rolls are out of the desired phase relationship by an amount equal or almost equal to ND, one of the opposing plate cylinders can be advanced while the other remains stationary.

However, in some presses the amount of vibration caused by a single deviation by the number of degrees ND is not significant to print quality. The correction of the desired phase relationship then can be delayed until opposing rolls are out of the desired phase relationship by an amount equal to or almost equal to 2*ND. At that point, one of the plate cylinders can be advanced one revolution, and the opposing plate cylinder retarded.

The present invention also provides a method for setting the proper register and vibrations of a printing press comprising the steps of:

determining a good printed register position of a first set of opposing plate cylinders in a first color printing unit of a printing press and of a second set of opposing plate cylinders in a second color printing units of the printing press;

removing the first set of opposing plate cylinders from impression;

removing the second set of opposing plate cylinders from impression;

pulling the web through the first and second color printing units using a nip;

sending a last good printed register command to a controller to adjust the register of the first and second sets of opposing plate cylinders to the good printed register position; and determining vibrator stroke positions in the first and second printing units.

Preferably, the determining step is performed while the first and second set of plate cylinders are off impression.

The vibrator positions then may be altered by rotating the one or more of the plate cylinders so as to obtain the desired vibrator phase relationship.

The present invention also provides a device for identifying a vibrator roll stroke position with respect to a plate cylinder in a printing press comprising:

a sensor sensing a lateral position of a vibrator roll;

an incremental encoder for sensing rotation of a plate cylinder;

a counter for counting an output of the incremental encoder; and a controller for rotating the plate cylinder, the controller receiving inputs from the sensor and the counter.

Preferably, the controller resets the counter upon receiving a sensor signal from the sensor.

The present invention also provides a printing press comprising:

a first color print unit including first opposing plate cylinders, vibrator rolls, and first sensors for sensing lateral positions of the vibrator rolls;

a second color print unit including second opposing plate cylinders, second vibrator rolls and second sensors for sensing lateral positions of the second vibrator rolls; and a controller for removing the first and second plate cylinders from impression, the controller receiving inputs from the first sensors and the second sensors, and the controller capable of revolving at least one plate cylinder of the first and second opposing plate cylinders as a function of the inputs.

Preferably, the controller can set a last good print position of the plate cylinders when the cylinders are off impression.

BRIEF DESCRIPTION OF THE DRAWINGS

A preferred embodiment of the present invention is described below by reference to the following drawings, in which.

DETAILED DESCRIPTION OF A PREFERRED EMBODIMENT

Figure 1:
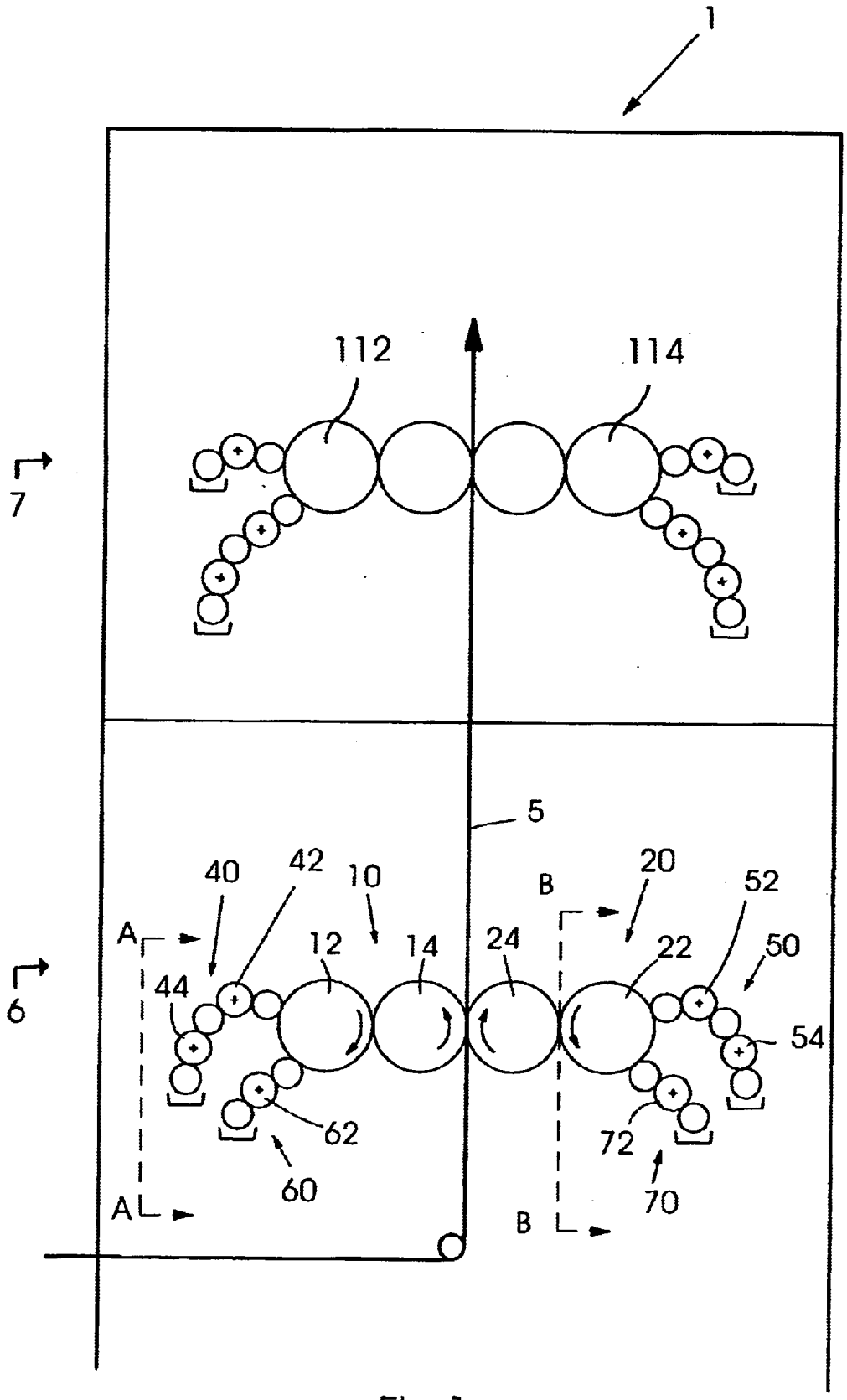
FIG. 1 shows an offset lithographic printing press according to the present invention.

FIG. 1 shows an offset lithographic printing press 1 having a first print couple 10 and a second print couple 20 of a first color print unit 6. A web 5 passes between the print couples 10, 20 so as to be printed on both sides. Print couple 10 includes a plate cylinder 12 and a blanket cylinder 14. Plate cylinder 12 preferably includes a flat lithographic printing plate fastened in an axially-extending gap of the plate cylinder 12, although other forms of plate cylinders such as digitally-imaged plate cylinders are possible. Blanket cylinder 14 preferably includes an axially-removable tubular-shaped blanket. Print couple 20 similarly has a plate cylinder 22 and a blanket cylinder 24. Plate cylinder 22 is driven independently from plate cylinder 12.

The web 5 then passes to a second color print unit 7, with a first plate cylinder 112, and a second plate cylinder 114.

Figure 2:
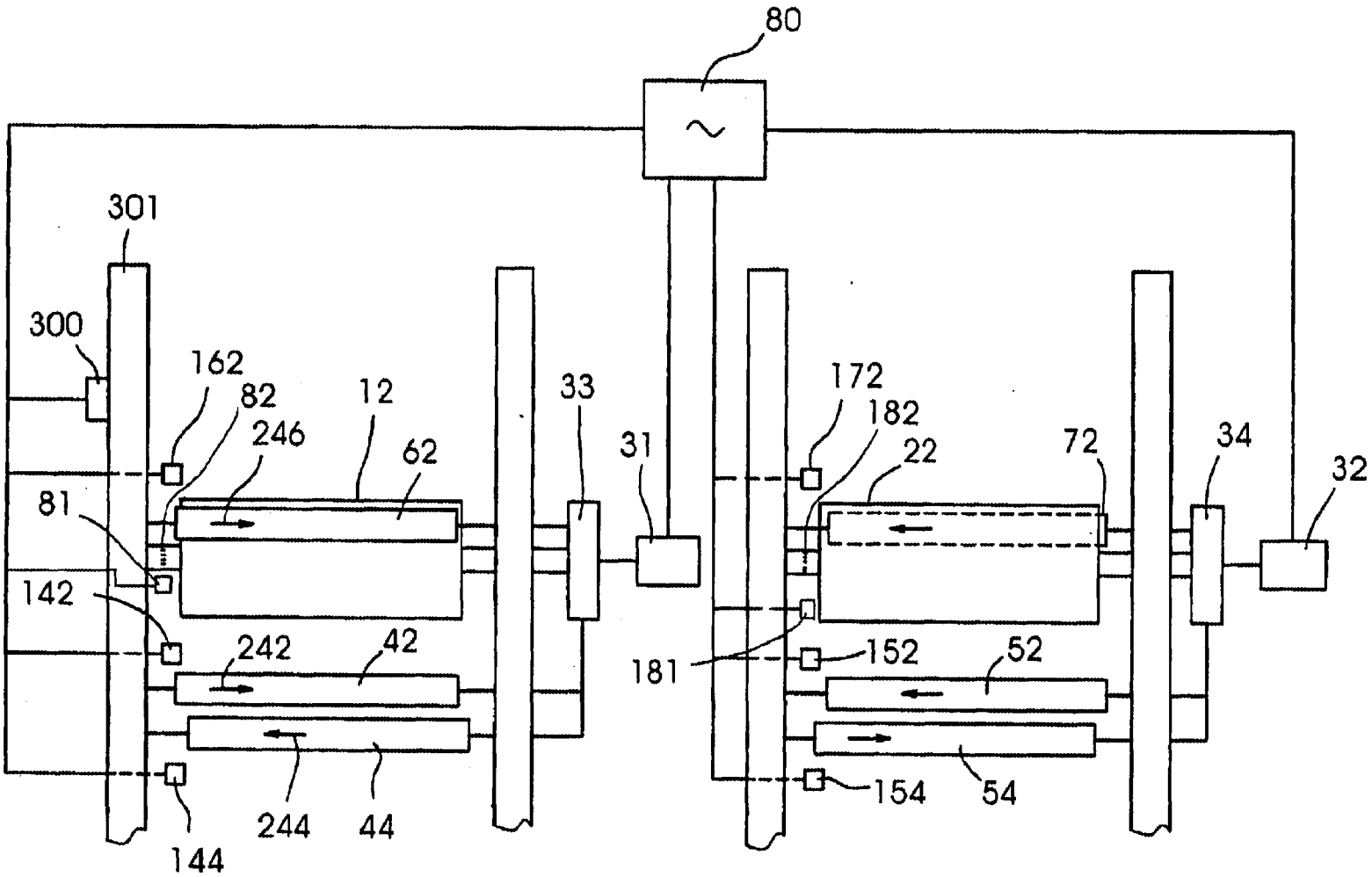
FIG. 2 shows a side view through cuts A—A and B—B of FIG. 1 of the offset lithographic printing press of FIG. 1 in side view, with various non-vibrating (non-reciprocating) rollers removed to aid clarity.

FIG. 2 shows views of printing press 1 through cross sections A—A and B—B as shown in FIG. 1, with only the vibration rollers of the inking and dampening units shown to improve clarity. A motor 31 and gearing 33 may drive plate cylinder 12, and blanket cylinder 14, while a second independent motor 32 drives plate cylinder 22, gearing 34 and blanket cylinder 24. Plate cylinders 12 and 22 thus also may be independently registered in a circumferential direction, for example, by the respective motors 31, 33. While a two motor configuration has been disclosed, other alternate embodiments where the plate cylinder 12 is independently registerable from plate cylinder 22 are possible, for example a three motor configuration where the plate cylinder 12 is driven by one motor, the two blanket cylinders 14 and 24 are driven by a second motor, and the plate cylinder 22 by a third motor. A single motor configuration is also possible, with for example helical gearing for altering a phase between the plate cylinders 12 and 22.

As shown in FIG. 1, printing press 1 also includes a first inking unit 40 and a first dampening unit 60 for plate cylinder 12, and second inking unit 50 and a second dampening unit 70 for plate cylinder 22. The inking units 40, 50 provide ink from a fountain to the plate cylinders 12, 22, respectively, while the dampening units 60, 70 provide dampening solution. In a lithographic process, the images on the plates of plate cylinders 12, 22 are transferred to the blanket cylinders 14, 24, respectively, the images then being transferred to both sides of web 5.

Inking unit 40 has a first vibrator roll 42 and a second vibrator roll 44, which both rotate and move laterally when the plate cylinder 12 rotates. Inking unit 40 is driven by motor 31, so that plate cylinder 12 and vibrator rolls 42 and 44 are geared together through gearing 33. For example, the vibrator rolls 42, 44 are geared so that the for each rotation of cylinder 12, the vibrator rolls 42, 44 move, for example, 0.154 strokes laterally (axially). A stroke is defined as a full forward and back lateral movement of the vibrator rolls, and stroke length is defined as the center to maximum distance. Thus in this example after a little more than six and a half rotations of the plate cylinder 12, the vibrator rolls 42, 44 move laterally a full stroke, returning to a same position. Preferably, a single rotation of the plate cylinder 12 causes roll 42 to move laterally by a number of degrees ND so that 360 divided by ND does not equal an integer. Thus an infinite number of phase angles between roll 42 and roll 52 may be achieved. However, if 360 divided by ND is an integer, the integer preferably is greater than 2.

Inking unit 40 also has other inking rolls which do not vibrate laterally, but merely rotate. The lateral vibration of rolls 42, 44 aids in providing an evenly distributed ink film to the plate cylinder 12.

The vibrator rolls 42, 44 may be of equal mass (for example about 60 kg), have stroke length of about 19 mm, and are phased 120 degrees with respect to one another, and with a dampening vibrator roller 62. In other words, the vibrator rolls, 42, 44 and the dampening vibrator roll 62 move in varying directions, as shown by arrows 242, 244 and 246. However, since the vibrators rolls 42, 44 and 62 are at different heights, and may have different weights or stroke lengths, a net vibration likely will result from the movement of the three vibrator rolls 42, 44, 62.

A dampening unit 60 for plate cylinder 12 also has the single vibrator roll 62, which aids in evenly distributing dampening solution (such as water) to the plate cylinder 12. Other dampening vibrator or non-vibrator rolls may be provided in the dampening unit 60. Vibrator roll 62 also is geared to the motor 31 which drives plate cylinder 12, and is geared so as to move 120 degrees with respect to the lateral movement of each of the vibrator rolls 42, 44. The distance of the lateral stroke, and the weight, of roll 62 may differ from that of rolls 42, 44. For example, the roll 62 may weigh 61 kilograms and have a fixed stroke length of 19 mm. The stroke length of the rolls 42, 44 may be variable.

Inking unit 50 and dampening unit 70 for second plate cylinder 22 also have vibrating rolls 52, 54, and 72, respectively. These vibrator rolls 52, 54 and 72 are geared through gearing 34 to the drive motor 32 for plate cylinder 22. Preferably, the rolls 52, 54 and 72 are phased 120 degrees from one another.

The roll 52 is preferably phased 180 degrees from roll 42, with roll 54 thus being phased 180 degrees from roll 44 and roll 62 phased 180 degrees from roll 72. Since the height of rolls 52 and 42 is similar, the height of rolls 54 and 44 are similar, and the height of rolls 72 and 62 are similar, according to mathematical models this counterphasing generally should minimize vibrations. The rolls 52, 54, 72 thus move in opposite directions from rolls 42, 44 and 62.

Sensors 142, 144, 152, 154, 162 and 172 can sense a lateral position of respective rolls 42, 44, 52, 54, 62, 72. The sensors preferably are proximity sensors, most preferably magnetic proximity sensors that sense a single position of the roll, for example when the roll reaches its furthest lateral position, which is thus a reference position.

If vibrator rolls 52, 54 and 72 are geared together, a single sensor 172 can be provided for the inking unit 50 and dampening unit 70. If vibrator rolls 42, 44, and 62 are geared together a single sensor 162 also can be provided for determining the lateral position of rolls 42, 44 and 62.

Incremental encoder 82, 182 attached to the plate cylinders 12, 22 respectively can be used to determine the rotation of each of the plate cylinders 12, 22. High speed counters 81, 181 respectively counts continuously as the plate cylinder rotates, providing for example 222 counts per plate cylinder revolution, and preferably more than at least 1000 counts per revolution. The exact position of the plate cylinder can be determined. By knowing the reference position of the vibrator rolls from the sensors, and since the plate cylinder and vibrator rolls are geared together, the exact lateral position of the vibrator roll can be determined.

Figure 3:
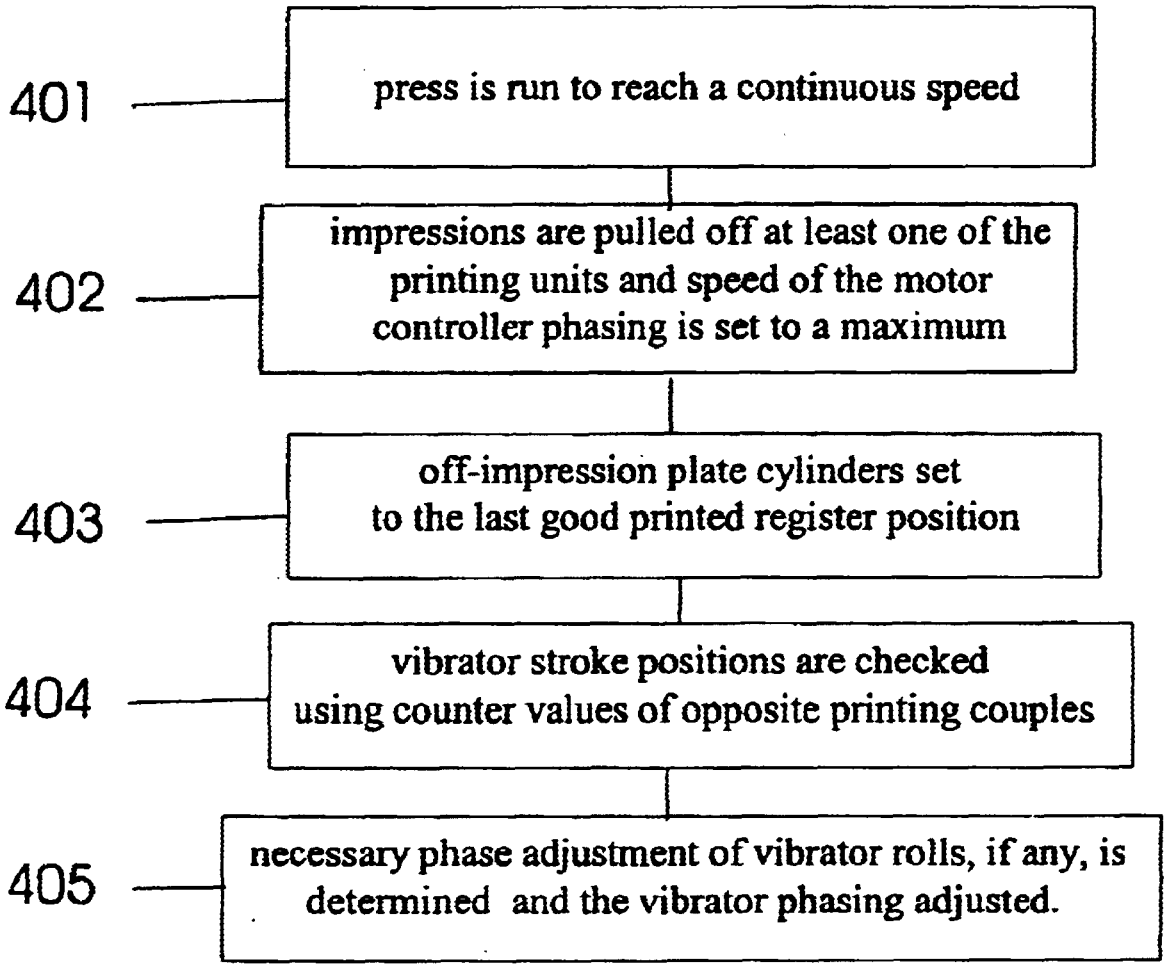
FIG. 3 shows a flowchart of a preferred method of the present invention.

FIG. 3 shows a flowchart of a preferred method of the present invention. First, in step 401 the press 1 is run to reach a continuous speed, for example approximately 10 meters/minute. Second, in step 402, impressions are pulled off (i.e. the blanket cylinders moved away from the web) at least one of the printing units 6, 7 (typically there are at least four such printing units), while impressions remain on at least one unit so that the paper can be pulled through the machine. The speed of the motor controller phasing is then set to a maximum to permit adjustments to be made quickly.

In step 403, a command is sent to controller 80 (FIG. 2) to set the off-impression plate cylinders to the last good printed register position, so that the plates are properly registered.

In step 404, the vibrator stroke positions are checked for each vibrator roll associated with an off-impression plate cylinder. As a vibrator stroke position reaches the respective reference position, the respective high speed counters 82, 182 are set to zero. The counters then increase depending on the rotation of the plate cylinders 12, 22 respectively. To check the stroke position, the counter values of opposite printing couples are "frozen" or read at an exact instant of time so as to read the counter values for counters 82, 182. The exact location or phase of the vibrator rollers, e.g. rollers 62 and 72, can be determined by the counter values.

After the stroke positions of opposing vibrating rollers have been established, the optimum adjustment is determined and the vibrator phasing adjusted in step 405. If rotating one of the plate cylinders 12, 22 by 360 degrees in one direction would bring the vibrator rollers 62, 72, for example, closer to being 180 degrees out of phase, for example, that plate cylinder 12, 22 can be rotated. If the opposing rollers 62, 72 are out of the desired phase difference by two or more rotations of a plate cylinder, one of the plate cylinders 12 can be rotated in one direction (e.g., advanced) and the other 22 rotated in the opposite direction (retarded).

In an alternate embodiment, if the opposing vibrator rollers are only one plate revolution away from being in the proper phase relationship, no change is made. The adjustment is only made when two or more revolutions are needed, since a single revolution out of phase may only cause minor disturbances and adjustment time can thus be saved.

Once the adjustment is made for one or more print units off impression, these units may be returned to impression for printing. Any print units not adjusted may then be adjusted by moving them off impression and repeating steps 401 to 405.

While 180 degrees has been listed as a desired phase difference, depending on the construction of the printing press and the location, namely the height, of the vibrator rolls 42, 44, 52, 54, 62, 72, the desired phase difference between the first vibrator rolls 42, 44 and 62 and the second vibrator rolls 52, 54, 72 may vary. The desired phase difference can be based on a mathematic prediction, or by actual test results. For example, if the height, weight and stroke length of rolls 42 and 52, rolls 44 and 54 and rolls 62 and 72 similar, it can be predicted that a phase difference of 180 degrees between the rolls would minimize vibration, as roll 42 would move in the opposite direction of roll 52, roll 44 in the opposite direction of roll 55, and roll 62 in the opposite direction of roll 72. Mathematical modeling can also be used to determine a predicted desired phase difference between the rolls 42 and 52 even if the rolls are at different heights, for example. For example, a net forcing moment M due to 24 vibrators in an eight print couple tower could be modeled as M equals the sum from i=1 to 24 of the following: $w^2 * s_i * d_i * m_i * \sin(w * t + f_i)$, where w is the vibrator frequency, f is the phase of the vibrator relative to a reference, m is the mass of the vibrator, d is the distance to ground from the centroid of the vibrator, and s is the amplitude of the vibrator stroke. Since the phase f for one set of vibrators for a particular plate cylinder is related, the and if the phase for one set of vibrators varies by a constant phase difference df from a second set of vibrators, an optimal phase difference df can be determined in which the net forcing moment is minimized.

Alternately, an accelerometer, preferably a zero frequency accelerometer, or other sensor could be used to receive actual data on the vibrations generated in the press 1 as a function of phase differences between the rolls 42 and 52. A vibration sensor 300 can be placed on a frame 301 of printing press 1 to measure the vibrations. A desired phase difference thus can be determined corresponding to a minimized vibration of the press 1.

As shown in FIG. 2, printing press 1 also includes a controller 80 receiving inputs from sensors 142, 144, 152, 154, 162, 172 and counters 81 and 181. Controller 80 also controls the press drive and motors 31 and 32. Controller 80 may include one or more processors, for example, INTEL PENTIUM processors. Motor 31 drives plate cylinder 12, and thus controller 80 can set a circumferential register for plate cylinder 12 through motor 31, The circumferential register for plate cylinder 22 is set through motor 32 and controller 80. In order to alter a phase difference between rolls 42 and 52, one or both of the plate cylinders 12 or 22 is rotated so as not to alter the circumferential register of the plate cylinder, e.g. a single rotation of 360 degrees, in either a clockwise or counterclockwise direction, as described in step 405 of FIG. 3.

For example, plate cylinder 12 can be rotated in one direction 360 degrees. Depending on the relationship between the stroke length of roll 42 and the rotation of plate cylinder 12, the roll 42 (and rolls 44 and 62) moves laterally a certain amount, for example 0.154 of a vibrator stroke length. Thus a rotation of cylinder 12 while cylinder 22 remains stationary causes roll 42 to move 55.44 degrees (1 stroke length=360 degrees, so 0.154 stroke length=55.44 degrees) out of phase with respect to roll 52. Before printing, the controller 80 thus can rotate the cylinders 12 and 22 a number of single rotations in either direction so that the desired phase difference between rolls 42 and 52 is achieved.

In an alternate embodiment of the present invention, one or more vibration sensors 110, for example accelerometers, are placed on the frame of the printing press 1. The press 1 is run and tested for the amount of vibration. If the vibration exceeds a desired limit, the phase of the rolls 42 and 52 is altered so as to determine either a minimum vibration or a vibration which falls below the desired limit. The press 1 then may perform a print run.

Plate cylinder as defined herein can include any image cylinder, including for example a digitally-imaged cylinder which does not have a plate.

The desired phase difference as defined herein may be an approximation, for example to bring the press within a desired maximum operating vibration standard. The desired phase difference can thus be set to within an error margin of 6 degrees, for example.

The lateral movements of reciprocating vibration cylinders 42, 44, 52, 54, 62, 72 are shown in an exaggerated manner in FIG. 2 to aid clarity.

While only a single print unit has been described in detail in FIG. 1, it can be seen that another print unit could be stacked over the first print unit. Stacking can reduce the required footprint of the press, but the increasing height of the print units increases the vibrational effect of the vibration rolls. The present invention thus has particular applicability to printing presses with stacked printing units.

What is claimed is:

1. A method for identifying a lateral position of a vibrator roll in a print unit having a plate cylinder comprising the steps of:

sensing a reference lateral position of a vibrator roll;

setting a counter to a setting corresponding to the reference lateral position of the vibrator roll; and rotating a plate cylinder, the lateral position of the vibrator roll changing as a result of the rotating, the counter changing as a function of the rotating of the plate cylinder.

2. The method as recited in claim 1 wherein the counter is reset each time the vibrator roll reaches the reference lateral position.

3. The method as recited in claim 1 further comprising sensing a second reference lateral position of a second vibrator roll of an opposing print couple.

4. The method as recited in claim 3 further comprising setting a second counter is reset each time the second vibrator roll reaches the second reference lateral position.

5. The method as recited in claim 4 further comprising reading the counter and second counter amounts at a same instant in time.

6. The method as recited in claim 1 further comprising rotating the plate cylinder 360 degrees while off impression so as to adjust the lateral position of the vibrator roll.

7. A method for correcting a lateral position of a vibrator roll for a plate cylinder in a printing press comprising the steps of:

sensing a reference lateral position of a vibrator roll;

setting a counter to a setting corresponding to the reference lateral position of the vibrator roll;

rotating a plate cylinder, the lateral position of the vibrator roll changing as a result of the rotating, the counter changing as a function of the rotating of the plate cylinder so as to correspond to an actual lateral position of the vibrator roll;

determining a desired lateral position of the vibrator roll;

comparing the actual lateral position of the vibrator roll to the desired lateral position of the vibrator roll; and rotating the plate cylinder 360 degrees if the actual lateral position differs from the desired lateral position by a predetermined amount.

8. The method as recited in claim 7 wherein the desired lateral position is a function of a second lateral position of a second opposing vibrator roll and further comprising rotating a second plate cylinder associated with the second opposing vibrator roll 360 degrees.

9. A method for setting the proper register and vibrations of a printing press comprising the steps of:

determining a good printed register position of a first set of opposing plate cylinders in a first color printing unit of a printing press and of a second set of opposing plate cylinders in a second color printing units of the printing press;

removing the first set of opposing plate cylinders from impression;

removing the second set of opposing plate cylinders from impression;

pulling the web through the first and second color printing units using a nip;

sending a last good printed register command to a controller to adjust the register of the first and second sets of opposing plate cylinders to the good printed register position; and determining vibrator stroke positions in the first and second printing units.

10. The method as recited in claim 9 wherein the determining step is performed while the first and second set of plate cylinders are off impression.

11. The method as recited in claim 9 further comprising altering the vibrator stroke positions by rotating the one or more of the plate cylinders so as to obtain a desired vibrator phase relationship.

12. A device for identifying a vibrator roll stroke position with respect to a plate cylinder in a printing press comprising:

a sensor sensing a reference lateral position of a vibrator roll;

an incremental encoder for sensing rotation of a plate cylinder;

a counter for counting an output of the incremental encoder; and a controller for rotating the plate cylinder, the controller receiving inputs from the sensor and the counter.

13. The device as recited in claim 12 wherein the controller resets the counter upon receiving a sensor signal from the sensor.

14. A printing press comprising:

a first color print unit including first opposing plate cylinders, vibrator rolls geared to the first opposing plate cylinders, at least one first reference sensor for sensing reference lateral positions of the vibrator rolls, and at least one first angular sensor for determining angular positions of the first opposing plate cylinders;

a second color print unit including second opposing plate cylinders, second vibrator rolls, at least one second reference sensor for sensing second reference lateral positions of the second vibrator rolls, and at least one second angular sensor for determining second angular position of the second opposing plate cylinders; and a controller for removing the first and second plate cylinders from impression, the controller receiving inputs from the first and second reference sensors and the first and second angular sensors so as to determine lateral positions of the vibrator rolls and second vibrator rolls.

15. A printing unit comprising:

opposing plate cylinders, vibrator rolls geared to the opposing plate cylinders, at least one reference sensor for sensing reference lateral positions of the vibrator rolls, at least one first angular sensor for determining angular positions of the opposing plate cylinders; and a controller receiving inputs from the reference sensor and the angular sensor so as to determine and adjust lateral positions of the vibrator rolls.

* * * * *